United States Patent [19]

Norman

[11] Patent Number: 4,586,618

[45] Date of Patent: May 6, 1986

[54] STORAGE/DISPLAY SYSTEM

[75] Inventor: Timothy H. Norman, Swindon, England

[73] Assignee: Spafax Holdings, plc, Great Britain

[21] Appl. No.: 594,228

[22] Filed: Mar. 28, 1984

[30] Foreign Application Priority Data

Mar. 29, 1983 [GB] United Kingdom ..... 8308688
May 17, 1983 [GB] United Kingdom ..... 8313652

[51] Int. Cl.[4] ..... A47F 5/01

[52] U.S. Cl. ..... 211/133; 211/88; 211/181

[58] Field of Search ..... 211/88, 106, 133, 126, 211/181, 26, 133, 70.6, 59.1, 57.1; 248/220.2, 220.3, 222.2, 225.2, 175

[56] References Cited

U.S. PATENT DOCUMENTS 3,860,309 1/1975 Brendgord ..... 211/88 X
4,322,006 3/1982 Marschak ..... 211/88
4,363,494 12/1982 Schreiner ..... 211/126 X
4,401,222 8/1983 Kulikowski et al. ..... 211/126 X

FOREIGN PATENT DOCUMENTS 641091 5/1962 Canada ..... 211/59.1
3034771 4/1982 Fed. Rep. of Germany ..... 211/70.6
1335491 7/1963 France ..... 211/88
673737 11/1964 Italy ..... 211/106
705578 3/1954 United Kingdom.
767165 1/1957 United Kingdom.
1102977 2/1968 United Kingdom ..... 211/106
1230856 5/1971 United Kingdom ..... 211/106
2070915 9/1981 United Kingdom.
2098054 11/1982 United Kingdom.
2100118 12/1982 United Kingdom
2119231 11/1983 United Kingdom

*Primary Examiner*—Robert W. Gibson, Jr.
*Attorney, Agent, or Firm*—Lucas & Just

[57] ABSTRACT

A self-standing storage/display system for storing and displaying goods is disclosed. The system includes a grate attached to a frame and a display board attached to the frame above the grate and containers or hooks which connect with the grate to allow the goods to be displayed or stored. The bottom of the frame is bent to allow the stand to sit upright.

4 Claims, 11 Drawing Figures

STORAGE/DISPLAY SYSTEM

This invention relates to a storage/display system which is particularly suitable for the storage and display of goods.

According to the present invention a storage/display system comprises a grid and articles adapted to store and/or display goods, the articles being provided with means for supporting them from the grid.

Preferably the grid is formed from wires or bars (hereinafter termed wires for convenience) arranged substantially vertically and horizontally, conveniently in the form of grid squares.

In one construction the articles may be in the form of containers. In this case means for supporting the containers on the grid may comprise a hook member or members adapted to hook onto the grid. In this case the hook members may comprise flanges spaced from and extending downwardly with respect to the rear portion of the container. This arrangement enables them to be hooked onto the horizontal wires of the grid. Conveniently ribs are provided between the rear of the container and the upper portion of the flanges which are arranged at intervals along the length, and are adapted to rest, in use, on the horizontal wires of the grid. To this end they may have a curved radius substantially corresponding to the radius of curvature of the wire of the grid.

The flanges preferably extend along substanially the whole of the rear of the container and are interrupted at intervals to permit the passage of vertical grid wires. The interrupted flanges thus formed are each shaped so as to taper in a downward direction.

In one convenient arrangement the wires of the grid are spaced at 33.3 mm centres and the flanges are interrupted at corresponding intervals. The grid is conveniently formed by forward wires secured over rear wires, the forward wires being horizontal to carry the containers.

The containers are conveniently arranged so that at their ends they extend approximately half a length into the square of the grid so that another container can be placed adjacent thereto.

In another construction the article may comprise a generally hook-like member comprising a first portion adapted to bear on one side of the grid, and having means for supporting the goods therefrom, and a second portion adapted to engage two adjacent wires of the grid on opposite sides of the grid to retain the device in position.

The portions of the device may be arranged with respect to one another so that the second portion can only be inserted into or removed from the rectangles or squares of the grid by angular movement with respect thereto.

The invention also includes within its scope the container set forth, as well as the grid set forth.

The invention may be performed in various ways and one specific embodiment and a variation thereof will now be described by way of example with reference to the accompanying drawings in which.

Figure 1:
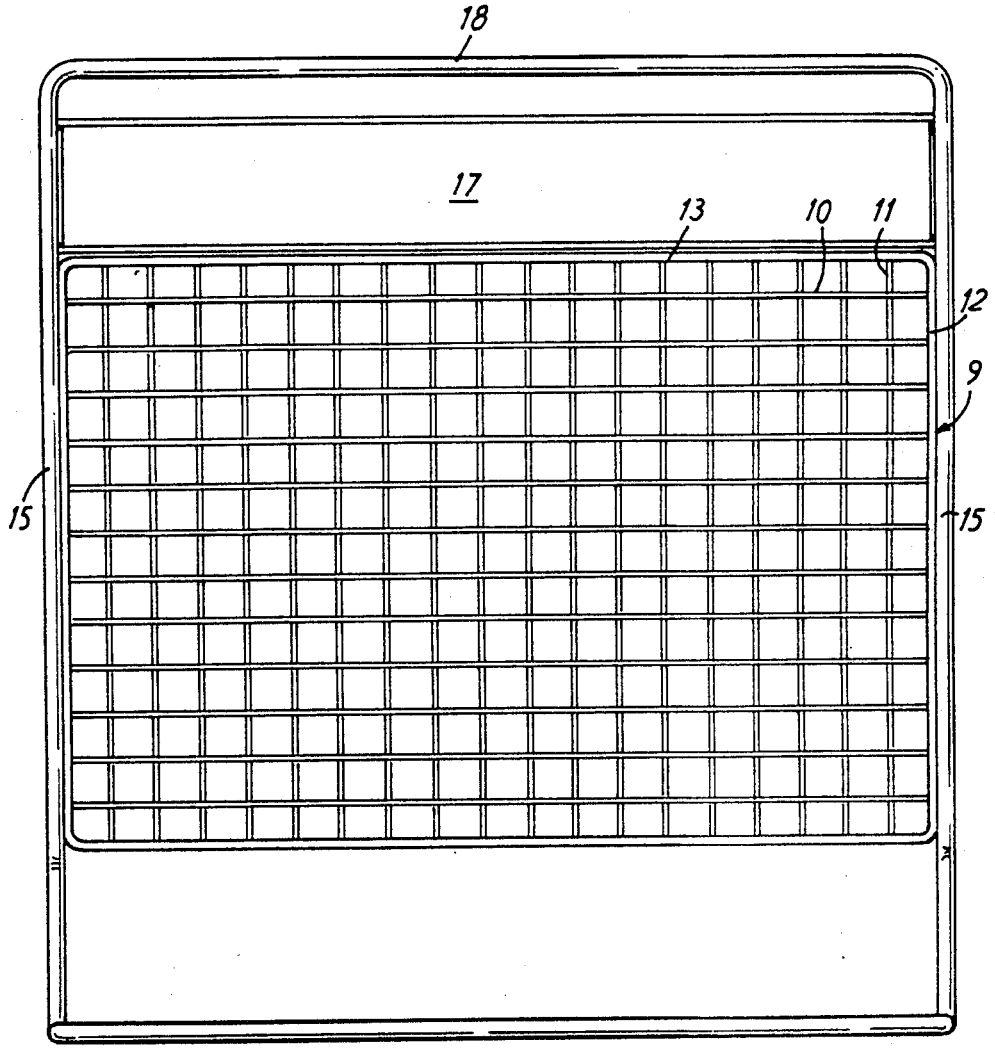
FIG. 1 is a front elevation of a grid arranged in a stand.

FIG. 1 shows a grid indicated generally at 9 formed from a series of parallel vertical and horizontal wires indicated at 10 and 11 respectively. Horizontal wires 10 are supported at their ends in upright side members 12 and vertical wires 11 in horizontal top and bottom members formed integrally therewith. The wires are metal coated in plastics material and of sufficient dimensions to provide a rigid grid. As can be seen in FIG. 1 the horizontal wires 10 are laid over the vertical wires 11 so that they are forward thereof. The wires are arranged in squares at 33.3 mm centres.

The grid is mounted in a frame comprising side supports 15 and an angled base 16 so that it can be free standing. At the upper part of the stand above the grid is a display board 17 an an upper supporting cross member 18 also forming a carrying handle.

Figure 2:
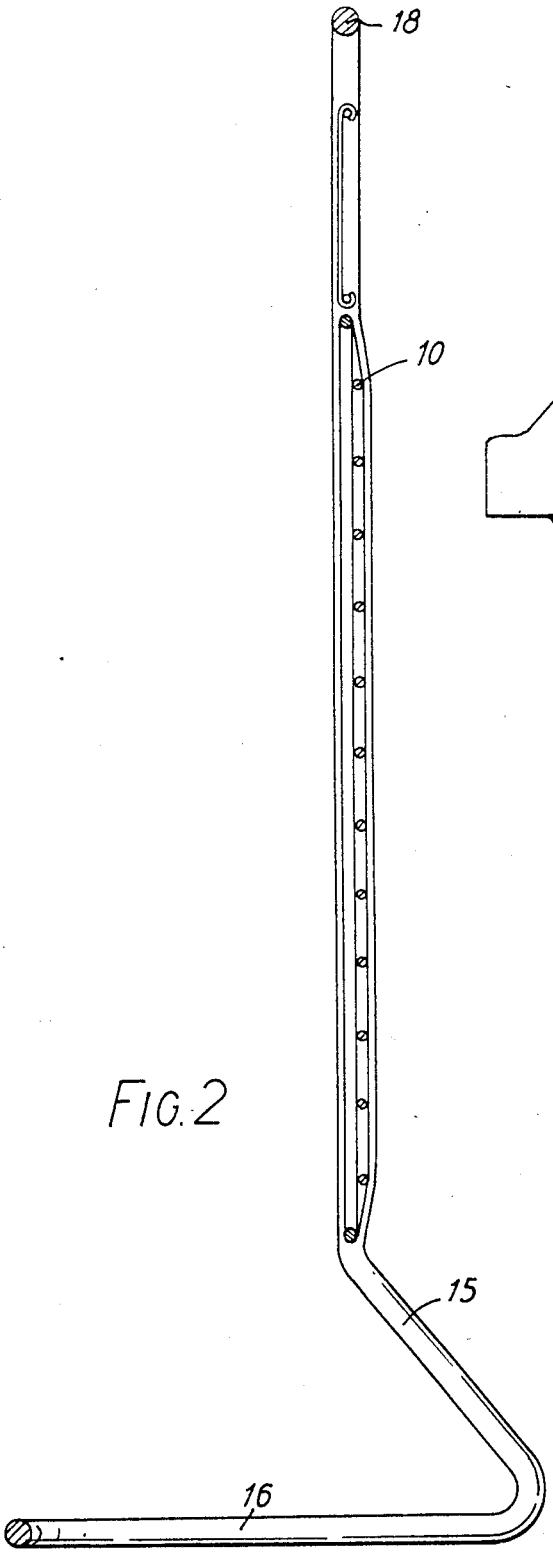
FIG. 2 is an end view of FIG. 1.
Figure 4:
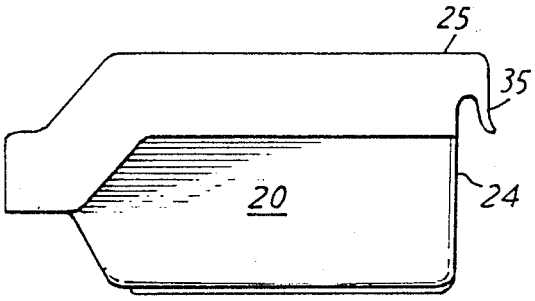
FIG. 4 is a side view of the container of FIG. 3.
Figure 6:
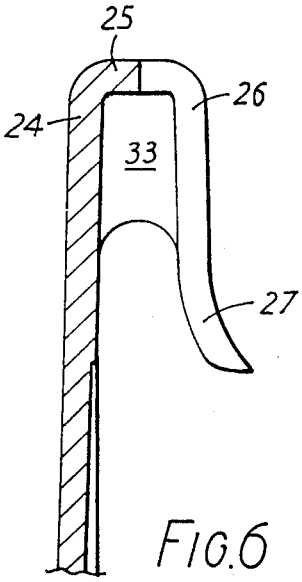
FIG. 6 is a section along the line D—D of FIG. 5.
Figure 3:
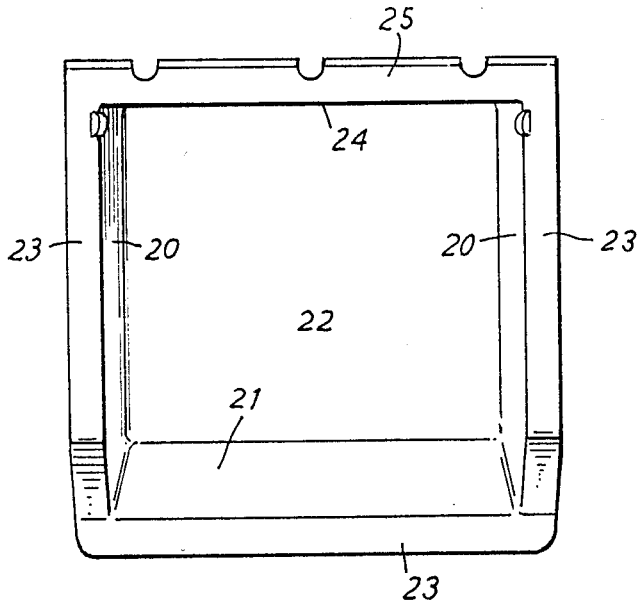
FIG. 3 is a plan view of a container for use with the grid shown in FIGS. 1 and 2.
Figure 5:
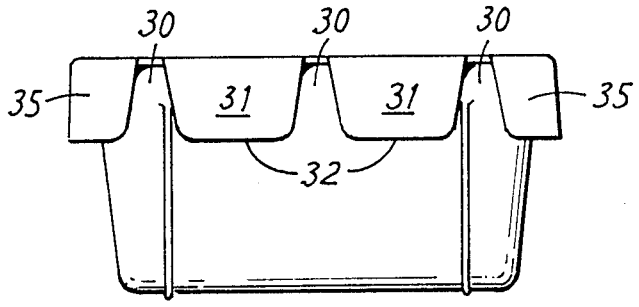
FIG. 5 is a rear view of the container shown in FIGS. 3 and 4.

FIG. 3 shows a container for mounting on the grid shown in FIGS. 1 and 2. The container is of generally box-like construction having side walls 20, a sloping front wall 21 and a base 22. The upper part of the container has a vertical flange extending around it and extending horizontally and outwardly from the side and front walls, and also from a rear wall 24, the rear outwardly extending flange being denoted by numeral 25. As can be seen in FIG. 5 the flange also extends downwardly a short distance all around the container. As is shown more clearly in FIGS. 4, 5 and 6 the downwardly extending portion of the rear flange is shaped with a vertically extending portion 26 which terminates in an outwardly curved end 27.

As can be seen more clearly in FIG. 5 the rear flanges 26 and 27 are interrupted at intervals as shown at 30, the flanges thus being divided into portions 31 which taper inwardly towards their bases 32 so that the intervals 30 are wider at the bottom than at the top, thus facilitating stacking the containers on the gird. The intervals 30 are arranged at the same 33.3 mm centres as the wires of the grid.

Extending between the rear wall 24 and the flange 26 are a series of ribs 33 spaced at intervals and which provide reinforcement and it is these ribs 27 which also rest on the wires 10. To this end they are radiused to conform to the radius of curvature of the wires of the grid.

Figure 7:
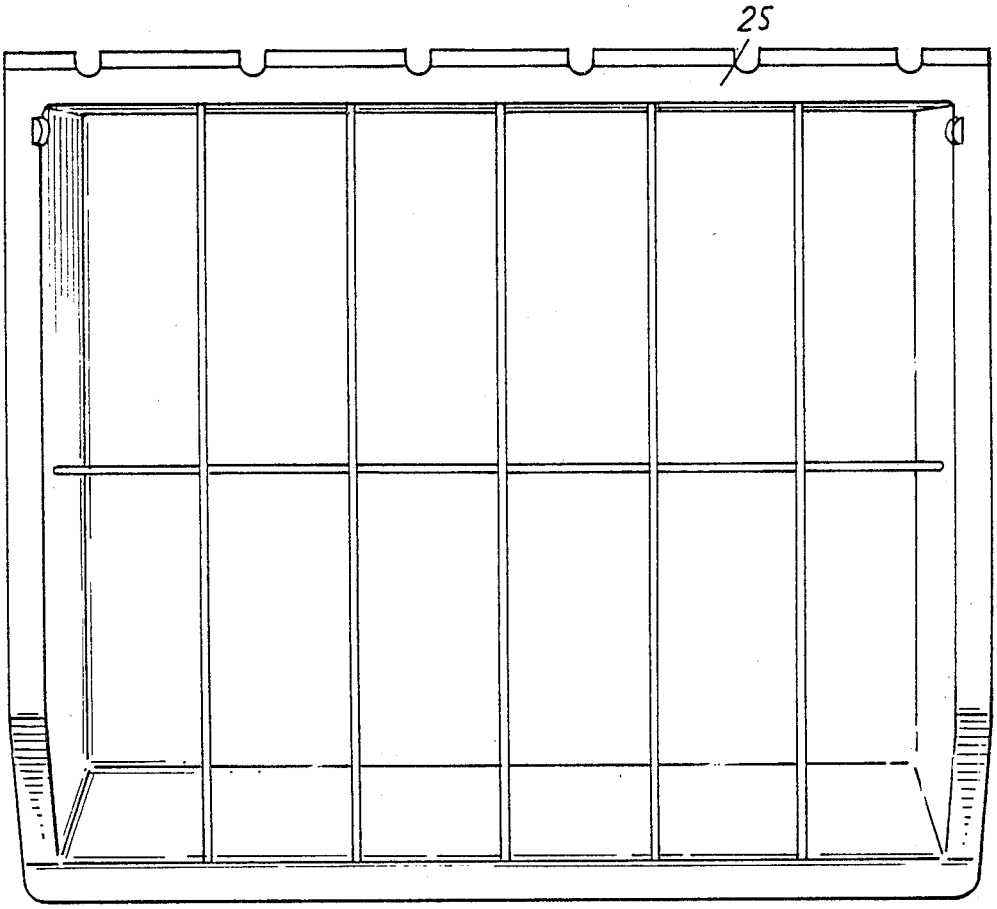
FIG. 7 is a view of an alternative container for use with the grid.
Figure 8:
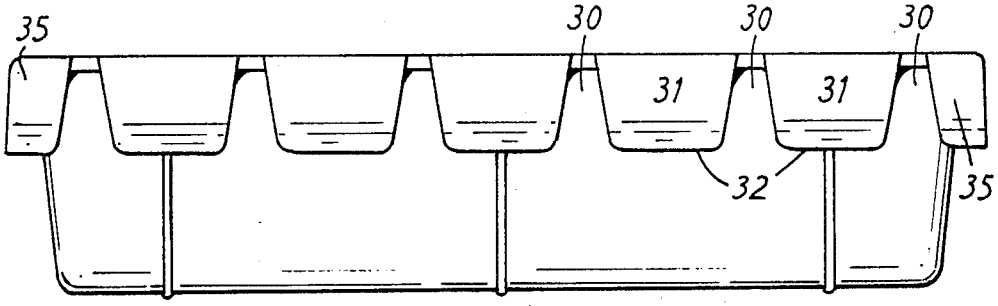
FIG. 8 is a rear view of the container shown in FIG. 7.

FIG. 7 shows an alternative container which can be used with a grid and in this case as can be seen is of somewhat larger dimensions but the features of the rear flange 25 are the same as those set out in respect of the container shown in FIG. 3. FIG. 8 shows the rear view of this container and it can be seen that this is formed from five rear flanges 26, 27 instead of only two as shown in FIG. 5.

In the arrangement shown in both containers there are end flanges 35 which are similarly shaped to the flanges 26, 27 except that they are slightly less than half the width. With this arrangement it is possible to stack containers of the same or different widths side by side on the grid and as close to one another as possible. The arrangement also provides stability at the ends of the container.

The containers can be of any width or depth provided that they have appropriate flanges and spaces between the flanges to accommodate the vertical wires.

The present invention thus provides a simple and practical way of stacking and displaying articles. The containers may be provided with lids which may be clear or opaque, or they may be provided open and/or have shrink wrapping applied to them so that the contents can be readily seen.

Although the grid shown in the arrangement of FIG. 1 is mounted on a stand the grid can be mounted on a wall or for use in a travelling workshop or sales vehicle. Moreover, although the grids can be described as being upright they may not necessarily be so and the flanges can be adapted, as could the shape of the container, to fit onto grids other than those which are vertically arranged. Also in a variation the grids might be provided with wires arranged other than at right angles to one another.

Figure 9:
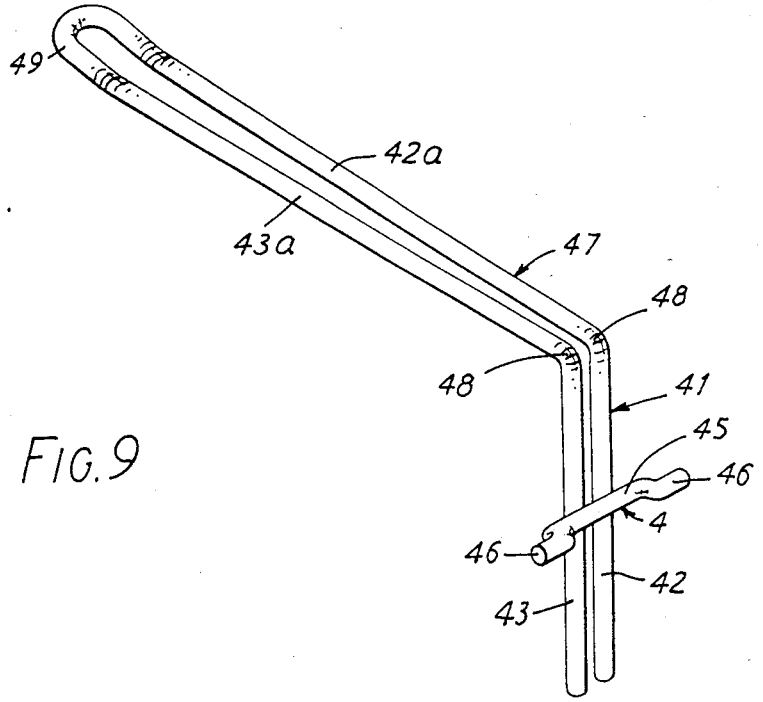
FIG. 9 is a perspective view of an alternative device for use with the present invention.
Figure 10:
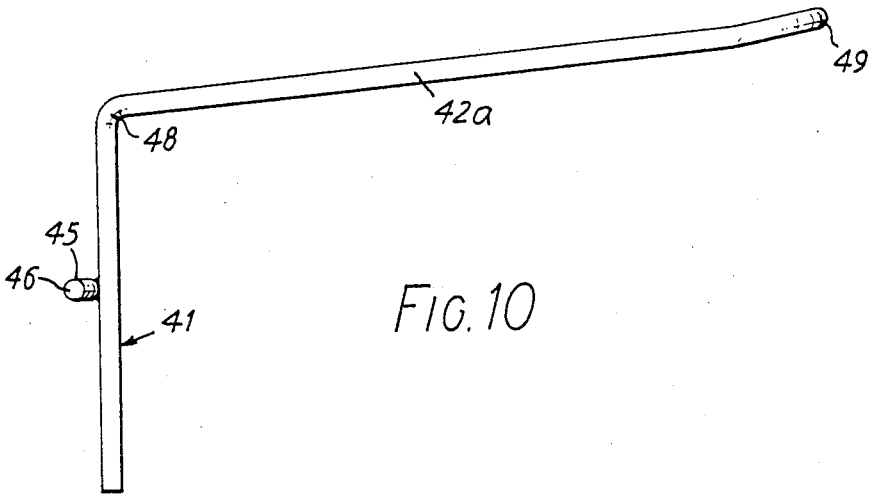
FIG. 10 is a side view of the device shown in FIG. 9.
Figure 11:
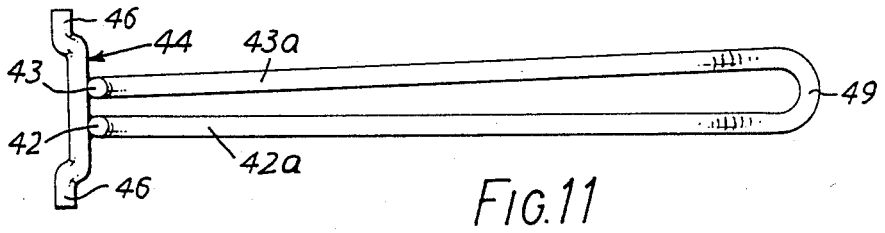
FIG. 11 is an underneath plan view of the device shown in FIG. 10.

An alternative arrangement is shown in FIGS. 9, 10 and 11. In these figures the article is in the form of a hook like member comprising a first portion indicated generally at 41 which itself comprises two parallel bars 42 and 43 and which are joined at approximately their centre by a second portion 44 being formed of a bar 45 which is stepped rearwardly at its ends as shown at 46.

A third portion indicated generally at 47 is formed by bending the bars 42 and 43 almost into a rightangle at 48 so that extensions thereof 42*a* and 43*a* extend forwardly of the first portion 1 and slightly upwardly with respect thereto. The bars 42*a* and 43*a* are joined at their end 49 by an integrally formed U-shaped portion.

The mesh of the grid is at 33.3 mm centres and the second portion 44 is arranged so that its dimensions are slightly less than the diagonal of individual squares. With this arrangement it is therefore necessary to twist the device with respect to the squares in order to insert the second portion 44 through the squares. It can then be rotated back to the vertical position and in this position the ends 6 will bear on adjacent upright bars of the grid. Thus, the load is carried by a second portion 45 bearing on the rear of the grid, and the first portion 41 bearing on the front of the grid. The first portion has sufficient extending below the second portion 44 to extend over the next horizontal wire of the grid.

In a typical example, where the grid is 33.3 mm centres the second member 44 may be 40 mm wide whilst from this portion the first member 1 extends downwardly by 40 mm so extending over the next adjacent horizontal wire.

With the present invention a very simple hook is provided which can easily be placed on the grid and because of the twisting action required is provided with positive locking preventing inadvertent release.

Although the dimensions given are particularly suitable for a grid of 33.3 mm squares, they may vary individually, e.g. the portion 7 may be made longer or shorter, or all may vary according to requirements.

I claim:

1. A storage/display system having a frame with a plurality of containers supported thereon comprising:

(a) a frame having a pair of spaced vertical side supports, and a pair of spaced horizontal end supports;

(b) a grid of substantially vertical and horizontal wires mounted in said frame between said side supports; and (c) said plurality of containers having means for supporting said plurality of containers on said grid, the support means comprising a flange spaced from the rear of the container and extending generally parallel to the said rear and forming with the said rear at its lower end an opening to receive a horizontal wire of the grid and having a connector between the container and said flange against which said horizontal wire can abut and which supports said container, said container, said flange and said connector being a unitary structure, and at least two vertically extending slots in said flange and extending into said connector, said slots being located at predetermined spaced intervals to interconnect with and receive the vertical wires of the grid.

2. A storage/display system as claimed in claim 1 in which the sides of the container extending forwardly from the rear flange are spaced at half the distance of the widths of the vertically extending wires of the grid so as to permit two containers to be abutted side by side.

3. A storage/display system as claimed in claim 1 wherein the said plurality of containers includes containers of at least two different sizes.

4. A system as claimed in claim 1 in which the connector has a curved radius substantially corresponding to the radius of curvature of the horizontal wires of the grid.

* * * * *